US010088146B1

(12) United States Patent
Winton

(10) Patent No.: US 10,088,146 B1
(45) Date of Patent: Oct. 2, 2018

(54) MOTION LIGHT-UP PILL BOX

(71) Applicant: Suzanne Winton, Austin, TX (US)

(72) Inventor: Suzanne Winton, Austin, TX (US)

( * ) Notice: Subject to any disclaimer, the term of this patent is extended or adjusted under 35 U.S.C. 154(b) by 164 days.

(21) Appl. No.: 15/277,057

(22) Filed: Sep. 27, 2016

(51) Int. Cl.

| | |
|---|---|
| ***A61J 1/03*** | (2006.01) |
| ***F21V 23/04*** | (2006.01) |
| ***F21V 33/00*** | (2006.01) |
| ***A61J 7/00*** | (2006.01) |
| ***F21S 9/02*** | (2006.01) |

(52) U.S. Cl.
CPC ..... *F21V 33/0068* (2013.01); *A61J 1/03* (2013.01); *A61J 7/0069* (2013.01); *A61J 7/0084* (2013.01); *F21S 9/02* (2013.01); *F21V 23/0464* (2013.01); *F21V 23/0471* (2013.01); *A61J 2200/70* (2013.01)

(58) Field of Classification Search
CPC ..... A61J 1/03; F21V 23/0471
See application file for complete search history.

(56) References Cited

U.S. PATENT DOCUMENTS

| | | | | |
|---|---|---|---|---|
| 4,905,213 | A | 2/1990 | Masse | |
| 6,229,431 | B1 | 5/2001 | Weiner | |
| D464,895 | S | 10/2002 | Ng | |
| 6,749,319 | B1 | 6/2004 | Muse | |
| 7,040,776 | B2 | 5/2006 | Harrell | |
| 2003/0038053 | A1* | 2/2003 | Bramen | B65D 43/164 206/538 |
| 2014/0185277 | A1 | 7/2014 | Mongeli | |
| 2015/0061867 | A1* | 3/2015 | Engelhard | G06F 19/3462 340/539.18 |
| 2015/0257981 | A1* | 9/2015 | Arad | A61J 7/0481 340/573.1 |

FOREIGN PATENT DOCUMENTS

| | | | |
|---|---|---|---|
| WO | 2005020872 | A2 | 3/2005 |

* cited by examiner

*Primary Examiner* — John Chapman, Jr.

(57) ABSTRACT

The motion light-up pill box is a medication container that further comprises a motion-sensing device. When the motion-sensing device detects motion near the location of the medication container the motion-sensing device illuminates an indicating light that signals the location of the medication container. The motion light-up pill box comprises a medication container and a motion-sensing device. The medication container further comprises one or more chambers and one or more lids. The motion-sensing device mounts in a lid selected from the one or more lids.

2 Claims, 4 Drawing Sheets

MOTION LIGHT-UP PILL BOX

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary sciences including containers adapted for medical or pharmaceutical purposes, more specifically tray or container for holding and distributing medications.

SUMMARY OF INVENTION

The motion light-up pill box is a medication container that further comprises a motion-sensing device. When the motion-sensing device detects motion near the location of the medication container the motion-sensing device illuminates an indicating lamp that signals the location of the medication container.

These together with additional objects, features and advantages of the motion light-up pill box will be readily apparent to those of ordinary skill in the art upon reading the following detailed description of the presently preferred, but nonetheless illustrative, embodiments when taken in conjunction with the accompanying drawings.

In this respect, before explaining the current embodiments of the motion light-up pill box in detail, it is to be understood that the motion light-up pill box is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the motion light-up pill box.

It is therefore important that the claims be regarded as including such equivalent construction insofar as they do not depart from the spirit and scope of the motion light-up pill box. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
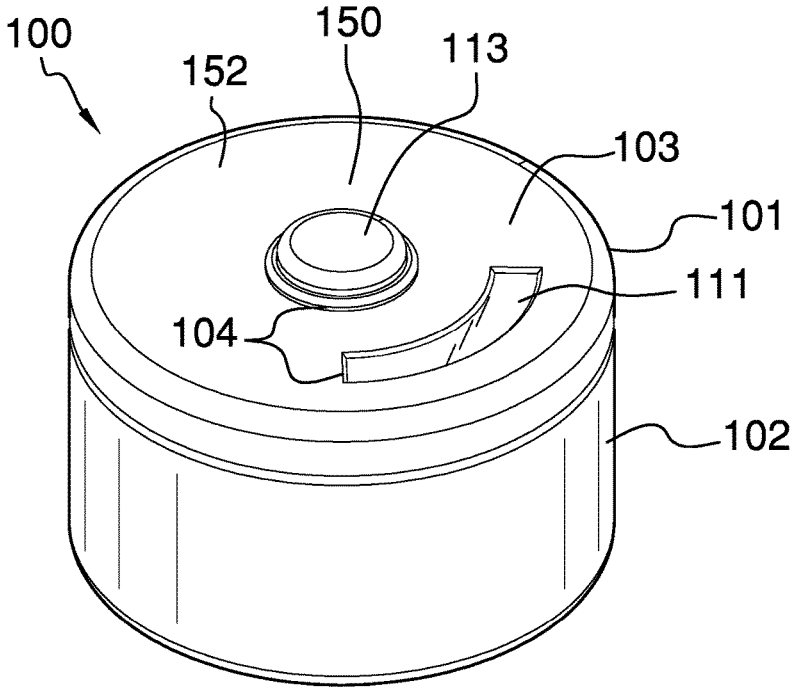
FIG. 1 is a closed perspective view of an embodiment of the disclosure.
Figure 2:
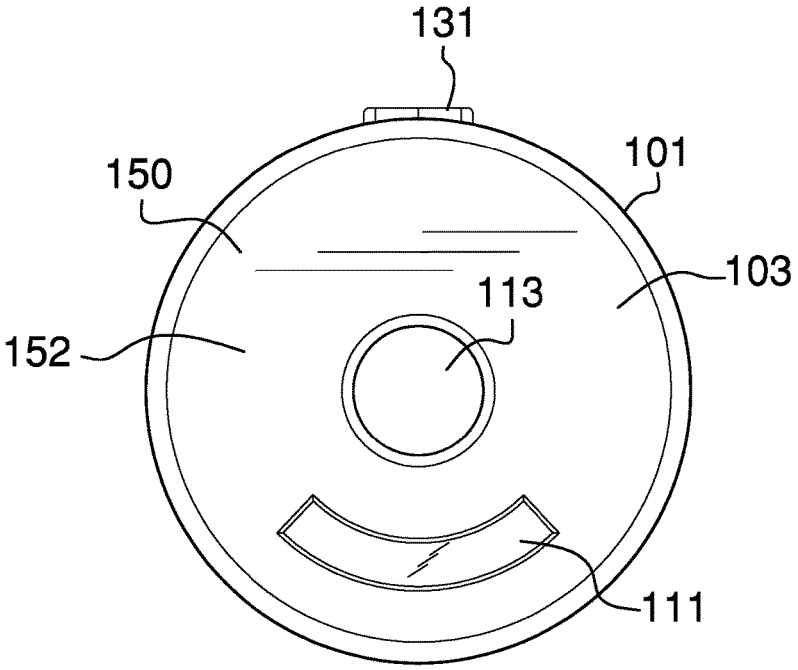
FIG. 2 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The motion light-up pill box 100 (hereinafter invention) comprises a medication container 101 and a motion-sensing device 104. The motion-sensing device 104 mounts in a lid selected from the one or more lids 103. When the motion-sensing device 104 detects motion near the location of the medication container 101 the motion-sensing device 104 illuminates an indicating lamp 113 that signals the location of the medication container 101. The medication container 101 further comprises one or more chambers 102 and one or more lids 103. The one or more chambers 102 is a single structure that is subdivided into one or more individual chambers such that medications 161 organized into individual dosages, generally assumed to be in the form of tablets or capsules, are stored within the medication container 101. As shown most clearly in FIG. 3, the one or more chambers 102 is a hollow structure that is formed with an open face 130. The open face 130 is used to permit access into the one or more chambers 102 for the loading and the removal of medication 161. The one or more chambers 102 is further defined with an interior 143 and an exterior 144. The open face 130 is further defined with a first perimeter 141.

Each individual lid contained within the one or more lids 103 is a plate structure that is further defined with a first surface 151 and a second surface 152. The number of individual lids contained within the one or more lids 103 equals the number of chambers contained within the one or more chambers 102. The first surface 151 of each individual lid selected from the one or more lids 103 is further defined with a second perimeter 142. The perimeter of the second surface 152 of the selected individual lid is the same as the perimeter of the first surface 151. The second surface 152 is the surface of the selected individual lid that is distal from the first surface 151 of the selected individual lid. Each individual lid selected from the one or more lids 103 further comprises a hinge 131 and a latch 132. The first perimeter 141 and the one or more second perimeters 142 correspond in such a manner that the one or more lids can be used to enclose the open face 130 thereby enclosing each of the one or more chambers 102.

The hinge 131 attaches the selected individual lid to an individual chamber selected from the one or more chambers 102. The selected individual lid attaches to the selected individual chamber such that: 1) the first surface 151 of the selected individual lid is proximal the interior 143 space of the selected individual chamber; 2) the first surface 151 of the selected individual lid encloses the interior 143 space of the selected individual chamber; and, 3) the first surface 151 of the selected individual lid rotates toward and rotates away from the interior 143 space of the selected individual chamber using the hinge 131 as a pivot. The latch 132 is a fastening device that secures any selected individual lid to its associated individual chamber when the selected individual lid is enclosing the interior 143 space of the associated individual chamber. The design and use of hinges and latches are well known and documented in the mechanical arts.

The one or more lids 103 further comprises a primary lid 150 that is selected from the one or more lids 103. The primary lid 150 is the individual lid that is selected to receive motion-sensing device 104. The motion-sensing device 104 comprises a motion sensor 111, a flip flop 112, a lamp 113, and a battery 114. As shown most clearly in FIGS. 1 and 2, the motion sensor 111 and the lamp 113 are mounted in the second surface 152 of the primary lid 150 such that: 1) the motion sensor 111 can monitor the exterior 144 space around the medication container 101; and, 2) the lamp 113 can illuminate the exterior 144 space around the medication container 101.

Figure 3:
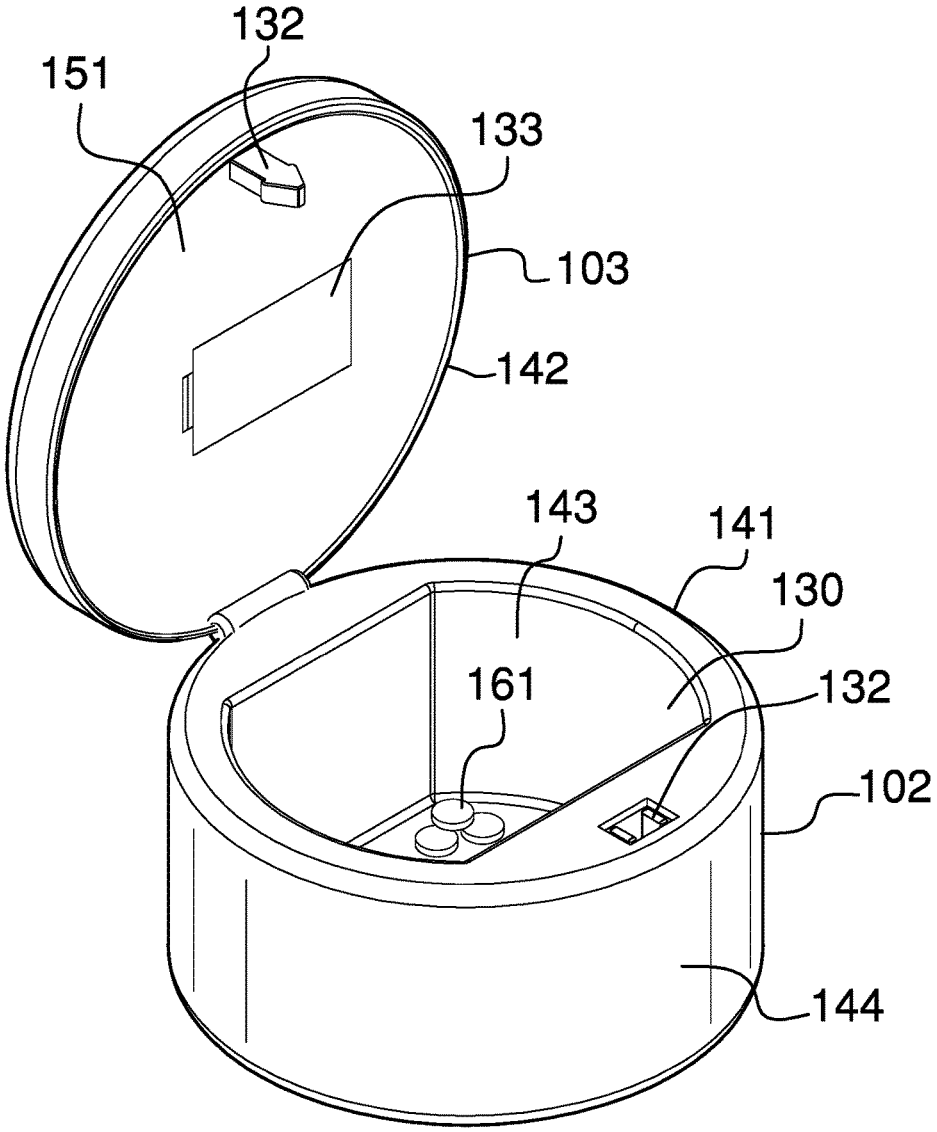
FIG. 3 is an open perspective view of an embodiment of the disclosure.
Figure 4:
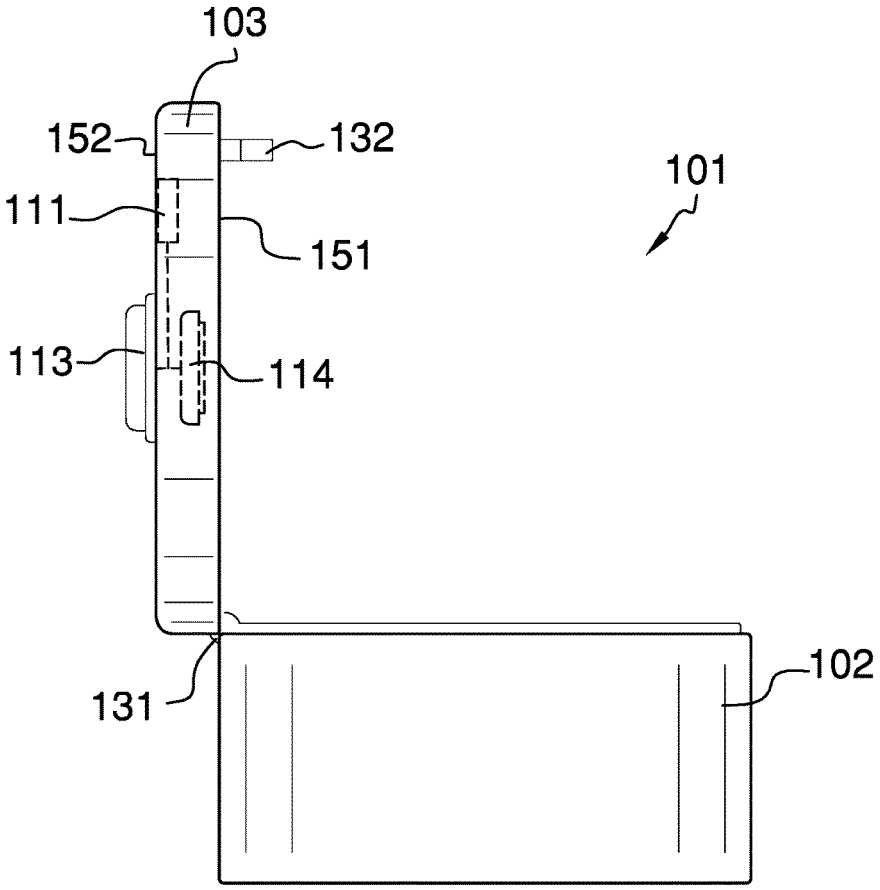
FIG. 4 is a side view of an embodiment of the disclosure.

As shown most clearly in FIGS. 3 and 4, the battery 114 is stored within a battery compartment 133 that is formed such that the battery compartment 133 is accessible from the first surface 151 of the primary lid 150. In the first potential embodiment of the disclosure, the battery 114 is a readily and commercially available non-rechargeable button cell battery 114. The motion sensor 111 is a commercially available motion sensor that detects infrared energies. The use of infrared technology is preferred because such a motion sensor 111 will detect motion in darkness. The flip flop 112 is a commercially available integrated circuit that changes its state, or stated less formally turns on and off, in response to a signal generated by the motion sensor 111. The flip flop 112, and if necessary an associated supporting amplifier circuit 117, drives the lamp 113. In the first potential embodiment of the disclosure, the motion sensor 111 is selected such that the motion sensor 111 will detect infrared motion within 24 cm (9.4 inches) of the motion sensor 111.

The theory of operation of the invention 100 is described in this paragraph. The lamp 113 is initially assumed to be off. When the motion sensor 111 detects motion, the motion sensor 111 sends a control signal to the flip flop 112 that changes the state of the flip flop 112 from an "off" state to an "on" state. When the flip flop 112 is in the on state, the flip flop 112 sends a signal to the lamp 113, or the associated amplifier circuit 117, that is used to illuminate the lamp 113. When the motion sensor 111 detects a subsequent motion, the motion sensor 111 sends a control signal to the flip flop 112 that changes the state of the flip flop 112 from the on state back to the off state thereby extinguishing the lamp 113.

Figure 5:
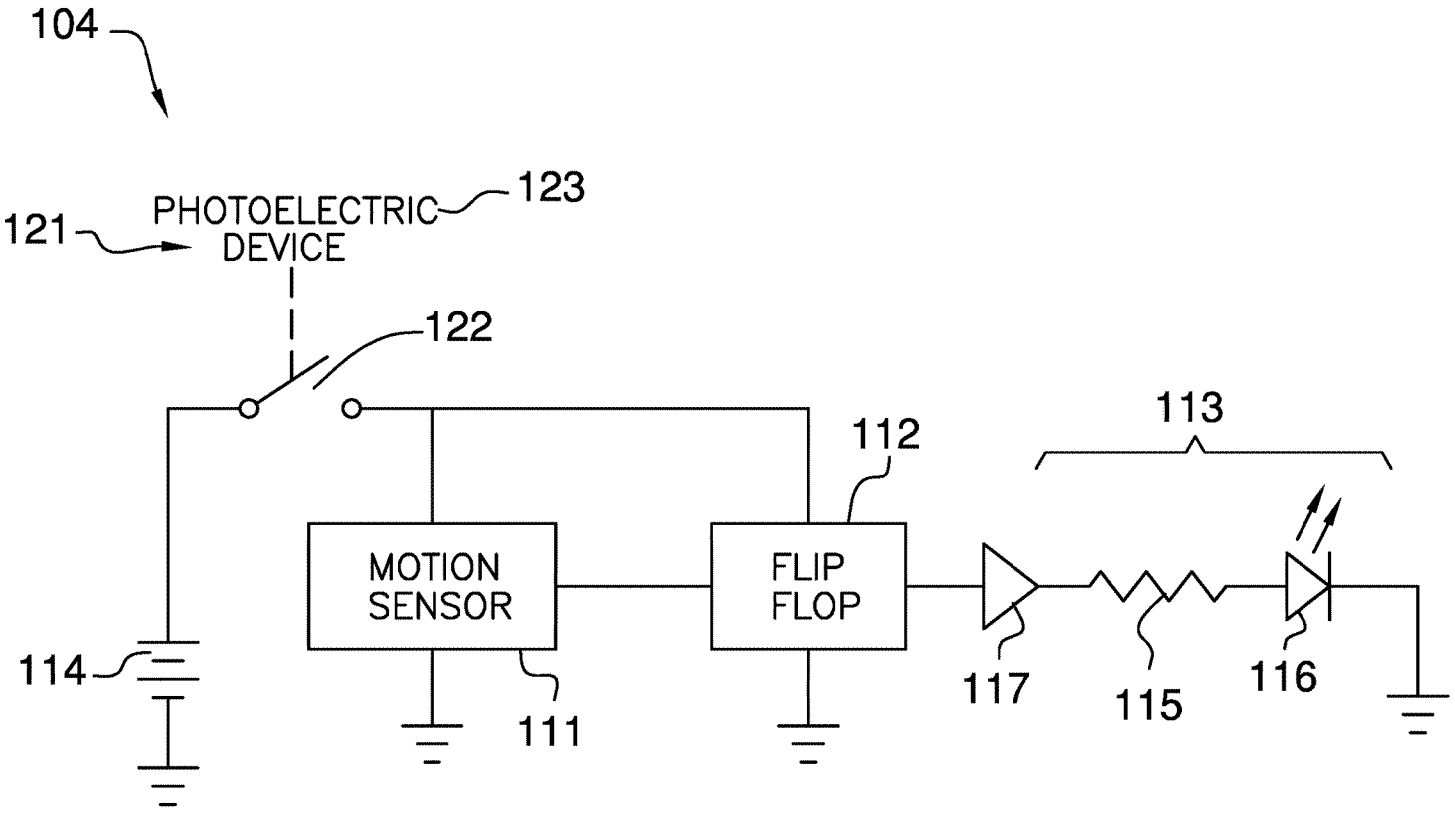
FIG. 5 is a block diagram of an embodiment of the disclosure.

In the first potential embodiment of the disclosure, as shown most clearly in FIG. 5, the lamp 113 further comprises a limit resistor 115 and an LED 116.

In a second potential embodiment of the disclosure, as shown most clearly in FIG. 5, the motion-sensing device 104 further comprises a photoswitch 121. The purpose of the photoswitch 121 is to limit the illumination of the lamp 113 to periods of darkness. Specifically, the photoswitch 121 is a readily and commercially available device. The photoswitch 121 comprises a photoelectric device 123 and a switch 122. The photoelectric device 123 closes the switch 122 in response to the exposure of the photoswitch 121 to darkness. The photoelectric device 123 opens the switch 122 in response to the exposure of the photoswitch 121 to light.

The following definitions were used in this disclosure:

Battery: As used in this disclosure, a battery is a container consisting of one or more cells, in which chemical energy is converted into electricity and used as a source of power.

Button Cell Battery: As used in this disclosure, a button cell battery is a disk shaped battery that is commonly used in powering watches and cameras.

Capsule: As used in this disclosure, a capsule is a gelatin-based sheath that is used to enclose a dose of an oral medication in preparation for ingestion.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Exterior: As used in this disclosure, the exterior is use as a relational term that implies that an object is not contained within the boundary of a structure or a space.

Flip Flop: As used in this disclosure, a flip flop is a bi-stable electronic device that is used to store information. The stable state of the flip flop can be changed through the application of one or more control signals. The flip flop is a circuit that is often used to store information.

Gel: As used in this disclosure, a gel is a substance comprising mostly of liquid (by mass) that is trapped in a cross-linked network of proteins and peptides that exhibits the properties of a solid.

Gelatin: As used in this disclosure, a gelatin is a mixture of proteins and peptides that is used to create a gel.

Hinge: As used in this disclosure, a hinge is a device that permits the turning, rotating, or pivoting of a first object relative to a second object.

Interior: As used in this disclosure, the interior is use as a relational term that implies that an object is contained within the boundary of a structure or a space.

Latch: As used in this disclosure, a latch is a fastening or locking mechanism. The use of the term latch does not necessarily but often implies the insertion of an object into a notch or cavity.

LED: As used in this disclosure, an LED is an acronym for a light emitting diode. A light emitting diode is a diode that is also a light source.

Light: As used in this disclosure, a light is an electrical device that generates visible light to illuminate objects so they can be seen.

Multi-Stable: As used in this disclosure, an object or system is considered multi-stable when the object or system has more than one set of (non-trivial) conditions within which the object or system will exhibit stability. An object or system with two such stable "states" is called bi-stable.

Perimeter: As used in this disclosure, a perimeter is one or more curved or straight lines that bounds an enclosed area on a plane or surface. The perimeter of a circle is commonly referred to as a circumference.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

Photoswitch: As used in this disclosure, a photoswitch is a switch that is actuated with light. The operation of a photoswitch is often based on the use of a photoelectric device.

Pivot: As used in this disclosure, a pivot is a rod or shaft around which an object rotates or swings.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Sheath: As used in this disclosure, a sheath is a flexible material that is used to cover an object.

Stable: As used in this disclosure, stable is an adjective that is applied to the state an object or system is in wherein the stable state of the object or system will not change unless: 1) a force is applied to or removed from the object or system; or, 2) a change is made to the energy stored within the system. Objects in a stable state my informally be referred to as in equilibrium.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tablet: As used in this disclosure, a tablet is a delivery method that comprises an active chemical compound. A tablet may further comprise auxiliary chemical compounds that perform a variety of functions including supplementing the stability and providing additional bulk for the active chemical compound. The tablet form of an active chemical compound and the auxiliary chemical compounds is of a power that is compressed into a single object that is generally taken orally. A tablet is generally formulated to provide a measured dose of the active chemical compound.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A pill box comprising:

a medication container and a motion-sensing device;

wherein the motion-sensing device mounts in the medication container;

wherein the motion-sensing device detects motion near the medication container;

wherein the motion-sensing device illuminates a lamp;

wherein the pill box stores a plurality of previously dosed medication;

wherein the medication container further comprises one or more chambers and one or more lids;

wherein the one or more chambers is a single structure that is subdivided into one or more individual chambers;

wherein each individual chamber selected from the one or more individual chambers contains a sub-plurality of previously dosed medication selected from the previously dosed medication;

wherein each individual chamber is a hollow structure that is formed with an open face;

wherein the open face to permit access into the interior of the individual chamber;

wherein the each individual chamber is further defined with an interior and an exterior;

wherein the open face is further defined with a first perimeter;

wherein each individual lid contained within the one or more lids is a plate structure that is further defined with a first surface and a second surface;

wherein the number of individual lids contained within the one or more lids equals the number of chambers contained within the one or more chambers;

wherein the first surface of each individual lid selected from the one or more lids is further defined with a second perimeter;

wherein the second surface is the surface of the selected individual lid that is distal from the first surface of the selected individual lid;

wherein each individual lid selected from the one or more lids further comprises a hinge and a latch;

wherein the hinge attaches the selected individual lid to an individual chamber selected from the one or more chambers;

wherein the first perimeter and the one or more second perimeters correspond in such a manner that the one or more lids can be used to enclose the open face thereby enclosing each of the one or more chambers;

wherein the selected individual lid attaches to the selected individual chamber such that the first surface of the selected individual lid is proximal the interior space of the selected individual chamber;

wherein the first surface of the selected individual lid encloses the interior space of the selected individual chamber;

wherein the first surface of the selected individual lid rotates toward and rotates away from the interior space of the selected individual chamber using the hinge as a pivot;

wherein the latch is a fastening device;

wherein the latch secures any selected individual lid to its associated individual chamber;

wherein the one or more lids further comprises a primary lid;

wherein the primary lid is the individual lid that is selected to receive the motion-sensing device;

wherein the motion-sensing device comprises a motion sensor, a flip flop, a lamp, and a battery;

wherein the motion sensor and the lamp are mounted in the second surface of the primary lid;

wherein the battery is stored within a battery compartment that is formed such that the battery compartment is accessible from the first surface of the primary lid;

wherein the motion sensor detects infrared energies;

wherein the flip flop is an integrated circuit that changes its state in response to a signal generated by the motion sensor;

wherein the flip flop drives the lamp;

wherein the flip flop further comprises an amplifier circuit, drives the lamp;

wherein the lamp further comprises a limit resistor and an LED connected in a series circuit;

wherein the motion-sensing device further comprises a photoswitch;

wherein the photoswitch limits the illumination of the lamp to periods of darkness.

2. The pill box according to claim 1 wherein the photoswitch comprises a photoelectric device and a switch;

wherein the photoelectric device closes the switch in response to the exposure of the photoswitch to darkness;

wherein the photoelectric device opens the switch in response to the exposure of the photoswitch to light.

* * * * *